US012691342B2

(12) United States Patent
Phillips et al.

(10) Patent No.: US 12,691,342 B2
(45) Date of Patent: Jul. 28, 2026

(54) GOLF BAG WITH TRAVEL AND PLAY MODE

(71) Applicant: TROLF VENTURES LLC, Provo, UT (US)

(72) Inventors: William C. Phillips, Scottsdale, AZ (US); Jerome Miles, Spanish Fork, UT (US); Quinn Riley, Provo, UT (US); Brayden Parady, Santaquin, UT (US)

(73) Assignee: Trolf Ventures LLC, Fountain Hills, AZ (US)

( * ) Notice: Subject to any disclaimer, the term of this patent is extended or adjusted under 35 U.S.C. 154(b) by 0 days.

(21) Appl. No.: 19/031,799

(22) Filed: Jan. 18, 2025

(65) Prior Publication Data

US 2025/0235759 A1 Jul. 24, 2025

Related U.S. Application Data

(60) Provisional application No. 63/622,833, filed on Jan. 19, 2024, provisional application No. 63/623,012,
(Continued)

(51) Int. Cl.
*A63B 55/40* (2015.01)
*A63B 55/00* (2015.01)
(Continued)

(52) U.S. Cl.
CPC ..... *A63B 55/40* (2015.10); *A63B 55/20* (2015.10); *A63B 55/30* (2015.10); *A63B 55/404* (2015.10);
(Continued)

(58) Field of Classification Search
CPC ..... A63B 55/40; A63B 55/20; A63B 55/30; A63B 55/404; A63B 55/408; A63B 55/50;
(Continued)

(56) References Cited

U.S. PATENT DOCUMENTS 1,920,308 A * 8/1933 Hiles ..... A63B 55/40
206/315.6

FOREIGN PATENT DOCUMENTS

DE 29919158 U1 * 1/2000 ..... A63B 55/00
EP 4506042 A1 * 2/2025 ..... A63B 55/40

* cited by examiner

*Primary Examiner* — Nathan J Jenness
*Assistant Examiner* — Jessica Kavini Tamil

(57) ABSTRACT

A bag for carrying a set of golf clubs while playing golf and while traveling. The bag includes first, second, third and fourth panels. Each panel has a middle section with first and second opposing faces, and with first and second opposite sides edges; a first wing section extending at a first angle from the first side edge of each panel; and a second wing section extending at a second angle from the second side edge of each panel. A first hinge connects the second wing section of the first panel to the first wing section of the second panel. A second hinge connects the second wing section of the second panel to the first wing section of the third panel. A third hinge connects the second wing section of the third panel to the first wing section of the fourth panel. At least one closure releasably connects the first wing section of the first panel to the second wing section of the fourth panel. The bag also includes first, second, and third club holding components, each connected to one of the first, second, third and fourth panels, each of the club holding components comprising at least three sleeves for receiving shafts of golf clubs. All of the hinges and the closure allow the bag to be folded into a playing mode with the connected wing sections touching each other and the first faces of the middle sections and the club holding components facing outward. All of the hinges and the closure also allow the bag to be folded into a travel mode with two of the first, second, third and fourth panels being adjacent with the middle sections facing and club holding components facing inward
(Continued)

and with an other two of the first, second, third and fourth panels are adjacent with the middle sections and club hold components facing inward.

20 Claims, 18 Drawing Sheets

Related U.S. Application Data filed on Jan. 19, 2024, provisional application No. 63/623,141, filed on Jan. 19, 2024, provisional application No. 63/622,790, filed on Jan. 19, 2024, provisional application No. 63/622,859, filed on Jan. 19, 2024.

(51) Int. Cl.
*A63B 55/20* (2015.01)
*A63B 55/30* (2015.01)
*A63B 55/50* (2015.01)
*A63B 55/60* (2015.01)

(52) U.S. Cl.
CPC ..... *A63B 55/408* (2015.10); *A63B 55/50* (2015.10); *A63B 55/60* (2015.10); *A63B 2209/08* (2013.01); *A63B 2209/10* (2013.01); *A63B 2225/055* (2013.01); *A63B 2225/093* (2013.01); *A63B 2225/68* (2013.01); *A63B 2225/682* (2013.01); *A63B 2225/685* (2013.01); *A63B 2225/687* (2013.01)

(58) Field of Classification Search
CPC . A63B 55/60; A63B 2209/08; A63B 2209/10; A63B 2225/055; A63B 2225/093; A63B 2225/68; A63B 2225/682; A63B 2225/685; A63B 2225/687
USPC ..... 206/315.3
See application file for complete search history.

GOLF BAG WITH TRAVEL AND PLAY MODE

CROSS-REFERENCE TO RELATED APPLICATIONS

This application claims priority to U.S. Provisional Patent Application No. 63/622,790, filed 19 Jan. 2024, and entitled Golf Bag with Travel and Play Mode; and U.S. Provisional Patent Application No. 63/622,833, filed 19 Jan. 2024, and entitled Golf Bag with Sleeves for Club Shafts; and U.S. Provisional Patent Application No. 63/622,859, filed 19 Jan. 2024, and entitled Golf Bag with Accessory Rack; and U.S. Provisional Patent Application No. 63/623,012, filed 19 Jan. 2024, and entitled Golf Bag with Club Head Cover and Wheels; and U.S. Provisional Patent Application No. 63/623,141, filed 19 Jan. 2024, and entitled Golf Bag with Suction Grippers for Mounting on a Vehicle.

TECHNICAL FIELD

The invention relates to golf bags, particularly to golf bags that are adapted for multiple functions, such as playing and traveling.

BACKGROUND

Golf bags are essential accessories for golfers, designed to carry and protect their clubs and equipment during a round of golf. These bags come in various styles and sizes to accommodate different preferences and needs. One of the most common types is the traditional carry bag, which features shoulder straps for easy carrying. These bags are lightweight and ideal for golfers who prefer to walk the course. They usually have multiple compartments to organize clubs, balls, apparel, and other accessories, keeping everything within easy reach during the game.

Another popular type of golf bag is the stand bag, which combines the convenience of a carry bag with an integrated stand mechanism. The stand can be deployed to keep the bag upright when not in use, eliminating the need to lay it on the ground and making it more accessible while walking between shots. Stand bags often feature additional pockets for extra storage, including specialized compartments for rangefinders, water bottles, and valuables. These bags are a favored choice for golfers who enjoy the benefits of walking but also appreciate the stability provided by the stand.

For golfers who prefer to use golf carts, there are cart bags designed specifically for this purpose. Cart bags are generally larger and heavier than carry bags since weight is less of a concern when the bag is on a cart. They come with features such as strap pass-throughs to secure the bag to the cart and forward-facing pockets for easy access. Cart bags often offer more storage space, allowing golfers to carry a broader range of gear without worrying about the bag's weight. Whether you prefer to walk or ride, there's a golf bag suitable for your needs, ensuring your clubs and accessories are well-organized and protected while you enjoy your time on the course.

Traveling with a golf bag can present several challenges due to the size, weight, and delicate nature of golf clubs. For example, many airlines impose size and weight restrictions on checked baggage, including golf bags. Oversized or overweight bags can result in additional fees or may not be allowed on the flight at all. Also, golf bags are bulkier and heavier than regular suitcases, making them more challenging to handle and transport throughout the airport. Maneuvering through crowds and tight spaces can be cumbersome. Golf clubs can be fragile, and mishandling during transit could lead to damage. Even with proper padding and protection, there's always a risk of clubs getting scratched or bent, especially if the bag is not handled with care. Golf bags may attract attention from airport security due to the presence of metal clubheads and other golf-related items. Fitting all your golf equipment, including clubs, balls, and other accessories, into the golf bag can be a challenge. Overpacking the bag might cause it to be too heavy or difficult to close properly.

SUMMARY

In a first aspect, the disclosure provides a bag for carrying a set of golf clubs while playing golf and while traveling. The bag includes first, second, third and fourth panels. Each panel has a middle section with first and second opposing faces, and with first and second opposite sides edges; a first wing section extending at a first angle from the first side edge of each panel; and a second wing section extending at a second angle from the second side edge of each panel. A first hinge connects the second wing section of the first panel to the first wing section of the second panel. A second hinge connects the second wing section of the second panel to the first wing section of the third panel. A third hinge connects the second wing section of the third panel to the first wing section of the fourth panel. At least one closure releasably connects the first wing section of the first panel to the second wing section of the fourth panel. The bag also includes first, second, and third club holding components, each connected to one of the first, second, third and fourth panels, each of the club holding components comprising at least three sleeves for receiving shafts of golf clubs. All of the hinges and the closure allow the bag to be folded into a playing mode with the connected wing sections touching each other and the first faces of the middle sections and the club holding components facing outward. All of the hinges and the closure also allow the bag to be folded into a travel mode with two of the first, second, third and fourth panels being adjacent with the middle sections facing and club holding components facing inward and with an other two of the first, second, third and fourth panels are adjacent with the middle sections and club hold components facing inward.

Preferably, the first and second angles are 135°. Also, preferably, the three of the panels have club holding components with four sleeves for inserting club shafts. The fourth panel preferably includes an accessory rack and has two sleeves for inserting club shafts.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative, and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, the term "golf bag" is intended to have a relatively broad meaning and to refer to a device configured to hold golf clubs.

As used herein, the term "golf club" is intended to refer to any one of assorted clubs, from irons, to woods to putters.

Figure 1:
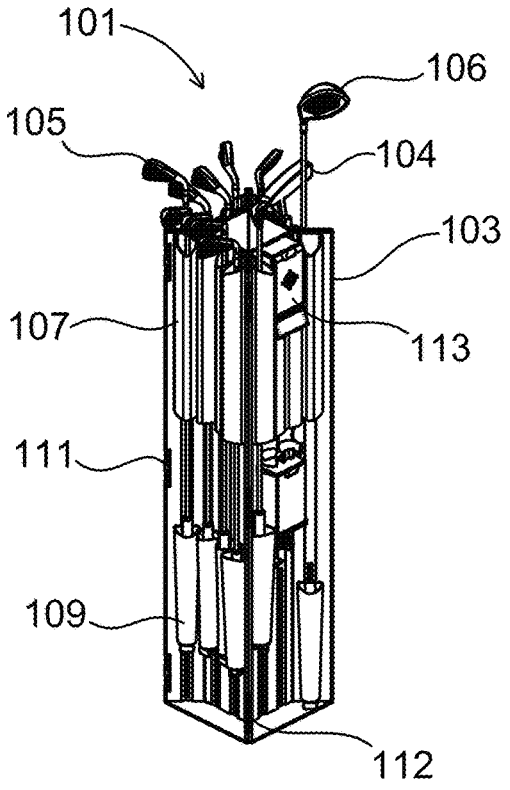
FIG. 1 is perspective view of a golf bag in the playing mode.

Referring to the FIG. 1, a golf bag 101 is seen in the playing mode. The bag preferably consists of four panels 103. As better seen in FIG. 8, each panel consists of a middle section, a first wing 705 and a second wing 707.

Preferably, the four panels are connected with hinges 111. In particular, the preferred bag includes (1) a first hinge between the second wing of the first panel and the first wing of the second panel, (2) a second hinge between the second wing of the second panel and the first wing of the third panel, (3) and a third hinge between the second wing of the third panel and the first wing of the fourth panel. A connector is provided to connect the second wing of the fourth panel to the first wing of the first panel. As illustrated in FIGS. 2-7, these three hinges and the connector allow the bag to be folded between the playing mode and the travel mode.

Figure 8:
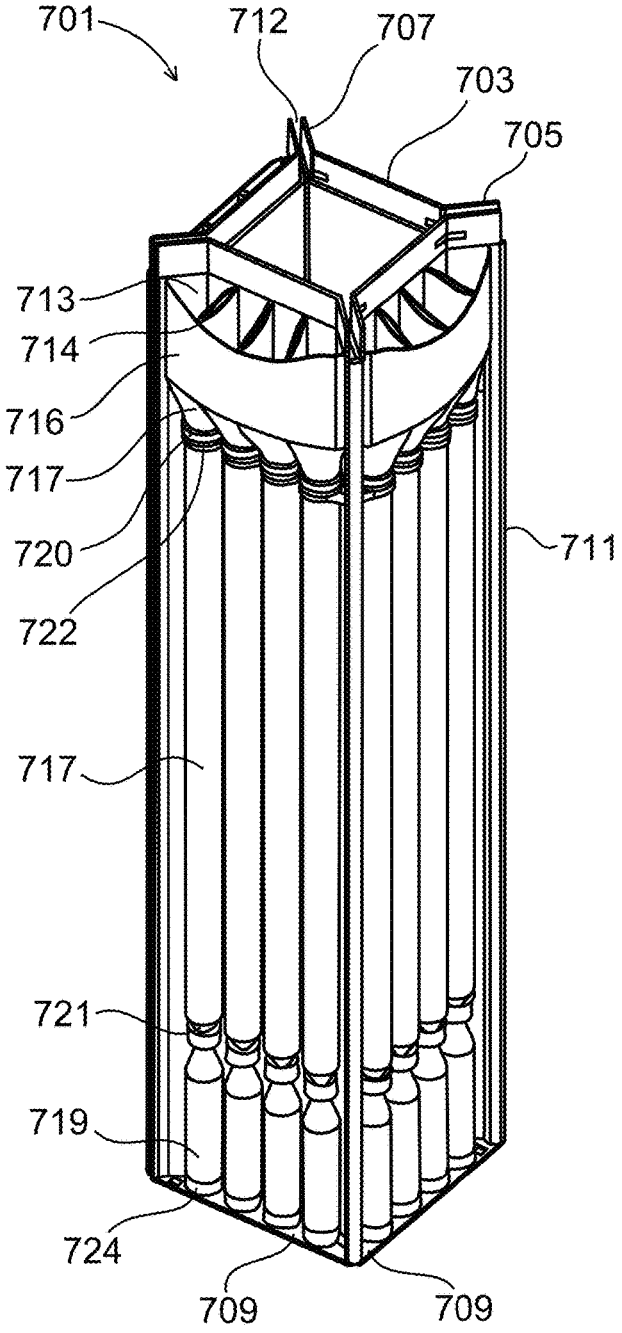
FIG. 8 is a perspective view of a golf bag of an alternative embodiment, in the playing mode.

As seen in FIGS. 1 and 8, in the playing mode, the panels are folded so the wings of adjacent panels are touching. In the preferred golf bag, there are four panels of similar shape and symmetrical. As a result, the angle between the middle sections and the wings is preferably 135°. In alternative embodiments, there may be fewer or more panels and the panels may not be the same shape and/or may not be symmetrical. In such alternative embodiments, the angle between the middle sections and the wings are be different. For example, in a golf back with six symmetrical, like-sized panels, the angle between the middle sections and the wings is 120°.

Referring to FIG. 1, golf clubs, including a driver 106, irons 105, and a putter 104 are held within sleeves attached to the first side of the panels. In this depicted embodiment, the sleeves are in the form of an upper portion 107 and a lower portion 109. The height of the lower portions 109 can be vertically adjusted by the golfer, so that the clubs protrude from the bag at the preferred height. They can also be vertically adjusted so that the club heads are all the appropriate height for the travel mode, as shown in FIG. 4.

Figure 2:
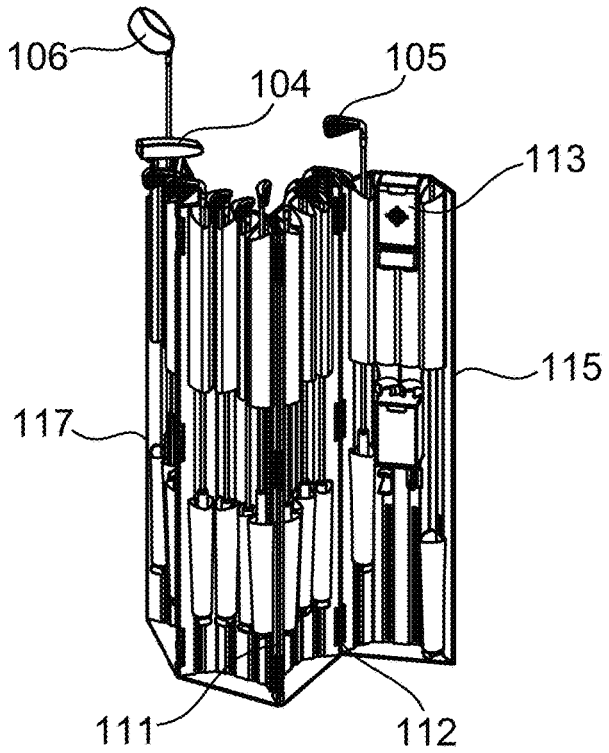
FIG. 2 is perspective view of the golf bag of FIG. 1, being transitioned to the travel mode.
Figure 3:
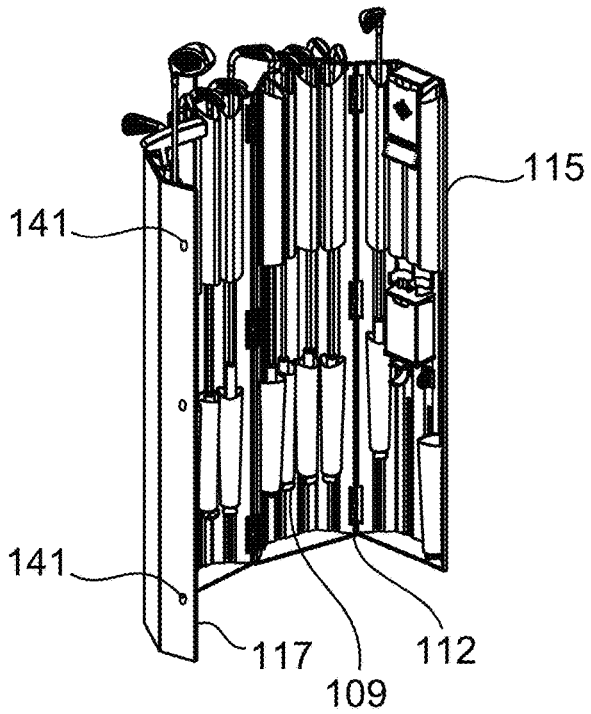
FIG. 3 is a perspective view of the golf bag of FIG. 1, being further transitioned to the travel mode.
Figure 4:
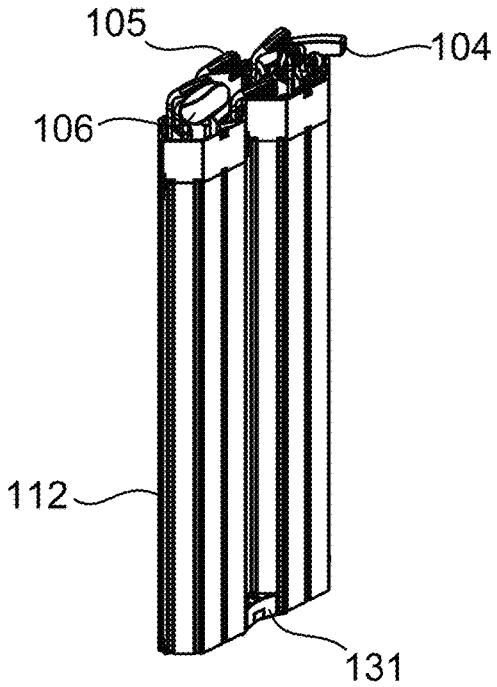
FIG. 4 is perspective view of the golf bag of FIG. 1, in the travel mode.

From the progression shown in FIGS. 2-4, in order to transition from playing mode to travel mode, the connector holding the first wing of the first panel and the second wing of the fourth panel is released and the panels are folded in the opposite direction. As seen in FIG. 4, in this travel mode, the first side of all the panels are facing inward. As such, the sleeves and the club shafts are all inside the bag. Also, two of the four panels are adjacent with the respective first faces facing each other and an other two of the four panels are likewise adjacent with the respective first faces facing each other.

Figure 5:
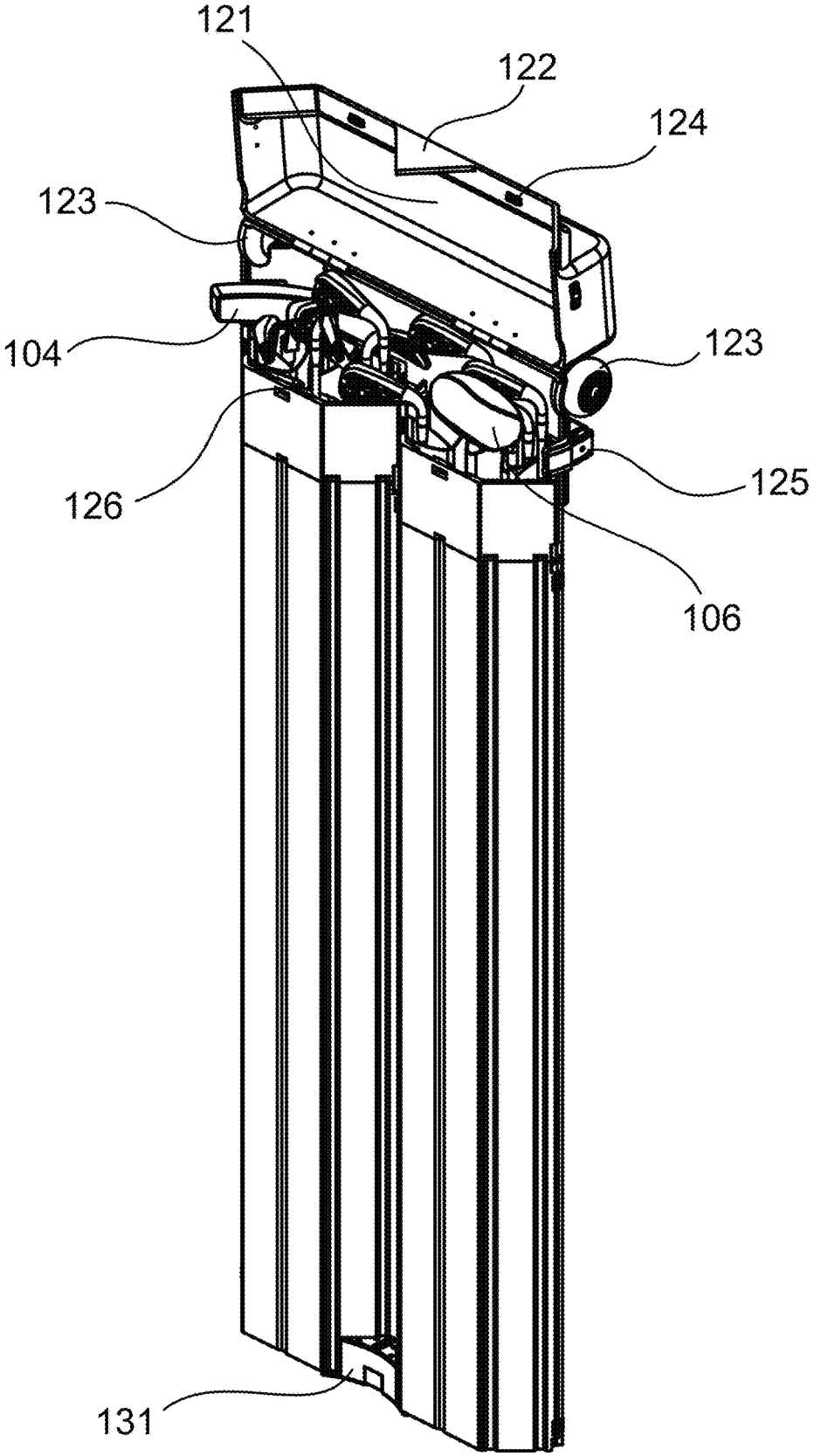
FIG. 5 is a perspective view of the golf bag of FIG. 1, in the travel mode with the club head cover partially attached.

Referring to FIG. 5, a club head cover or travel mode cover 121 is shown. Preferably, the cover is made with a hinge to allow it to be fitted over the club heads 106 and 104, and then closed to cover those club heads. A triangular projection 122 is included to close the space between the cover and the angled wings of the panels. A latch 125 is preferably used to hold the cover in the closed configuration. Protrusions 124 fitting into detents 126 facilitate locking the cover onto the bag.

Figure 6:
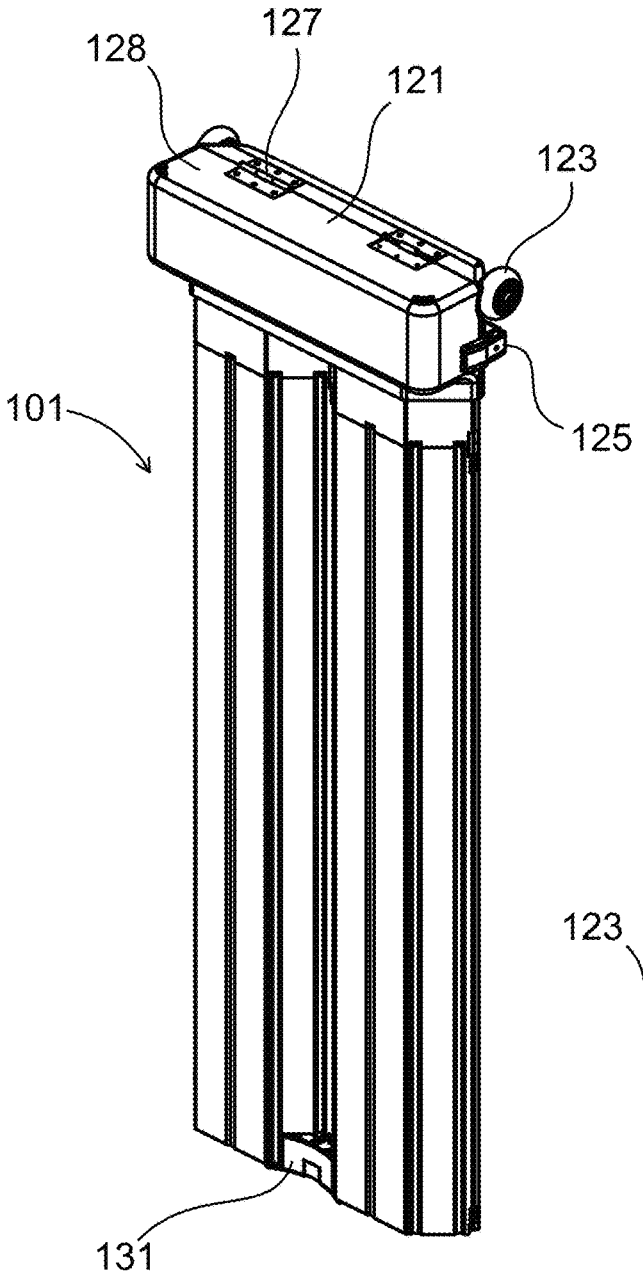
FIG. 6 is a perspective view of the golf bag of FIG. 1, in the travel mode with the club head cover fully attached.
Figure 7:
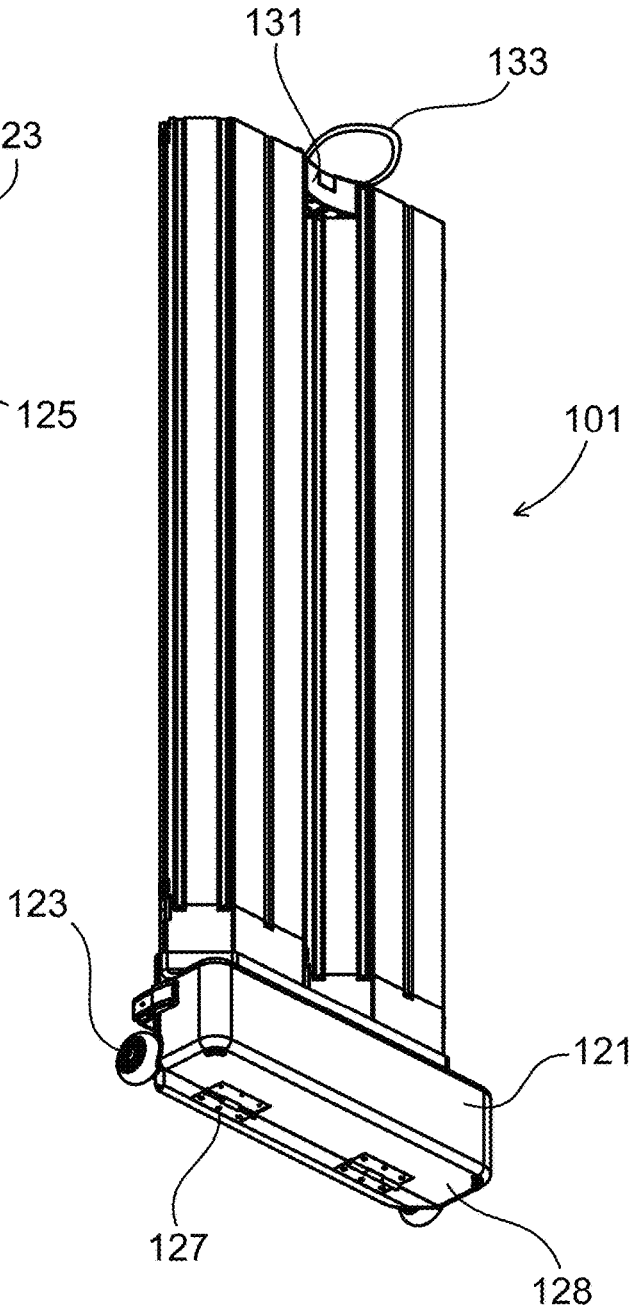
FIG. 7 is a perspective view of the golf bag of FIG. 1, in travel mode and inverted for using the wheels.

As seen in FIGS. 6 and 7, when closed, the cover 121 includes a flat base 128, in other words a "foot" for the bag. Preferably, this base is sized and angled so that bag can stand vertically on it own on the base. This is somewhat facilitated by the fact that the club heads are at the bottom of the bag when standing on the base. As a result, the standing bag is much more stable than the typical golf bag with the club heads at the top. In some embodiments it is preferred to set the angle between the base and the rest of the bag so as to allow the bag to lean slightly toward the center, in other words to put the center of gravity closer to the center of the base.

Figure 10:
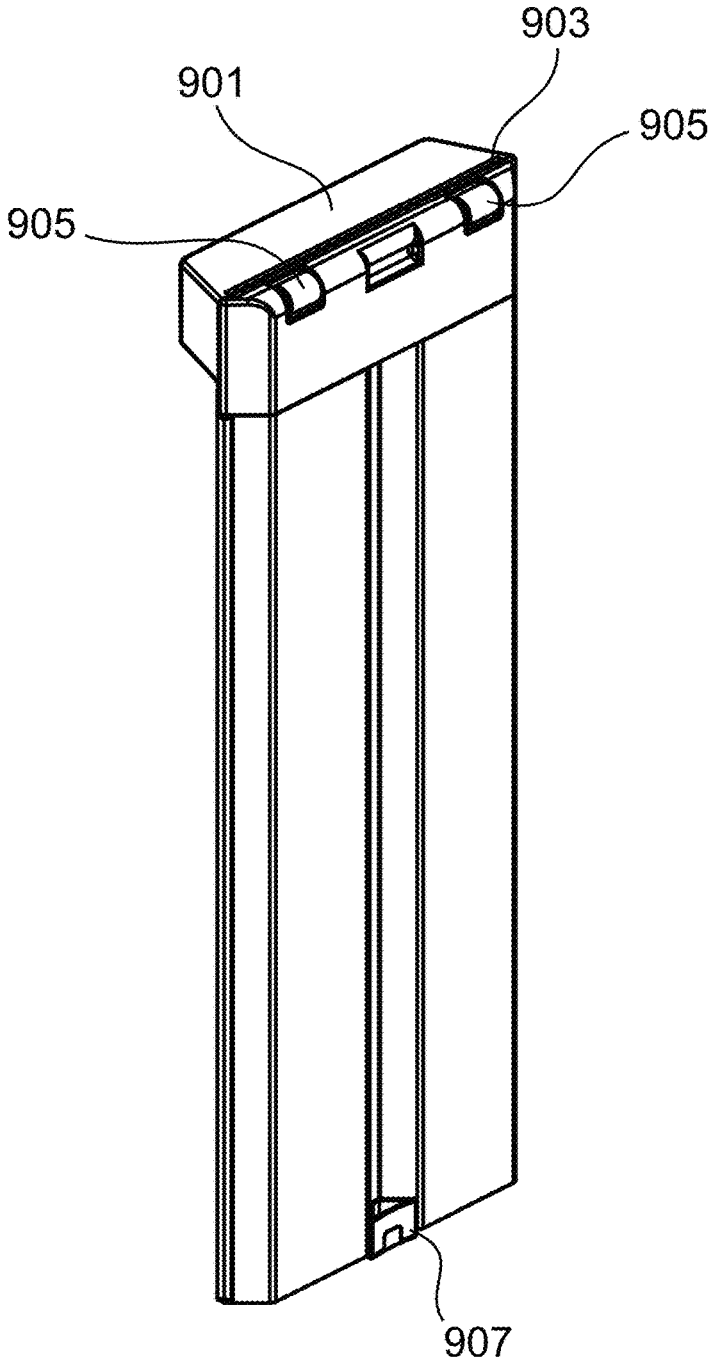
FIG. 10 is a perspective view of the golf bag of FIG. 8, in the travel mode with the club head cover attached.
Figure 11:
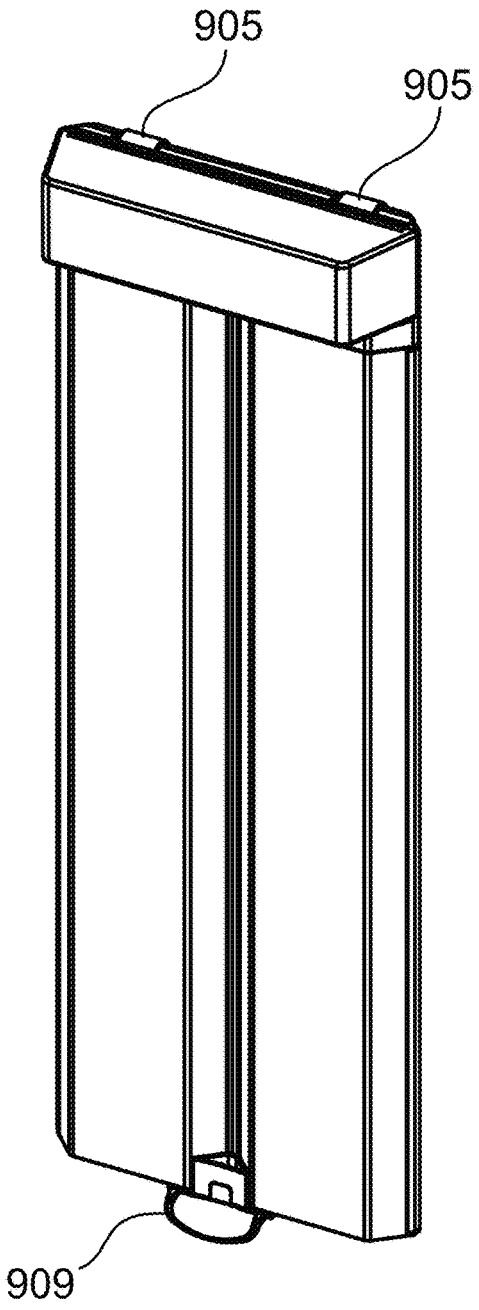
FIG. 11 is a perspective view of the golf bag of FIG. 10 from the opposite side.
Figure 12:
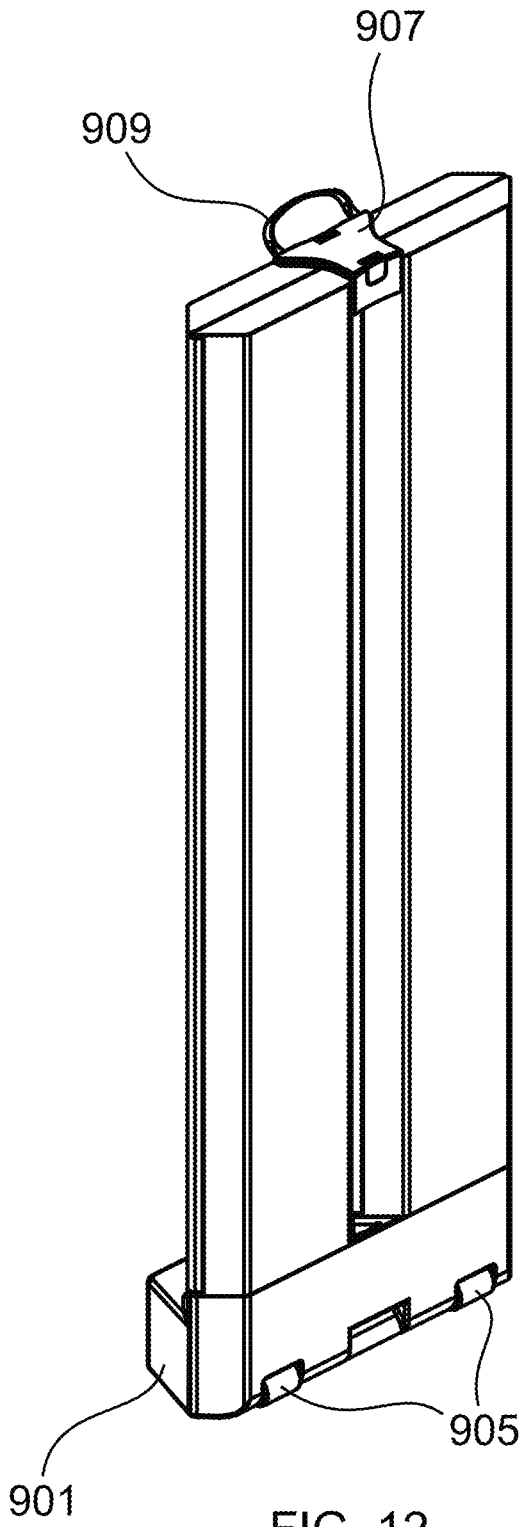
FIG. 12 is a perspective view of the golf bag of FIG. 10, standing on the club head cover.

As seen in FIGS. 5, 6 and 7, the travel mode cover also includes a pair of wheels 123. Naturally, these are useful when pulling or pushing the bag in travel mode. As also seen in FIGS. 10, 11 and 12, it is preferred that these wheels are positioned so they only touch the ground when the bag is leaned toward them. In this way, the wheels do not interfere with standing the bag on the base.

A block 131 is used to hold the panels in the travel mode. The block preferably includes a strap 133 that can be used for pulling the bag on the wheels.

While a connector is required to hold the bag in both the playing mode and the travel mode, it may not be the same element for both modes. For example, the connector for the playing mode may be a set of magnets 141 in the second wing of the fourth panel and in the first wing of the first panel. The connector for the travel mode is preferably a combination of the head cover 121 and the block 131. In alternative embodiments, another connector is provided that holds the end of the first wing of the first panel to the end of the second wing of the fourth panel when in the travel mode.

Figure 9:
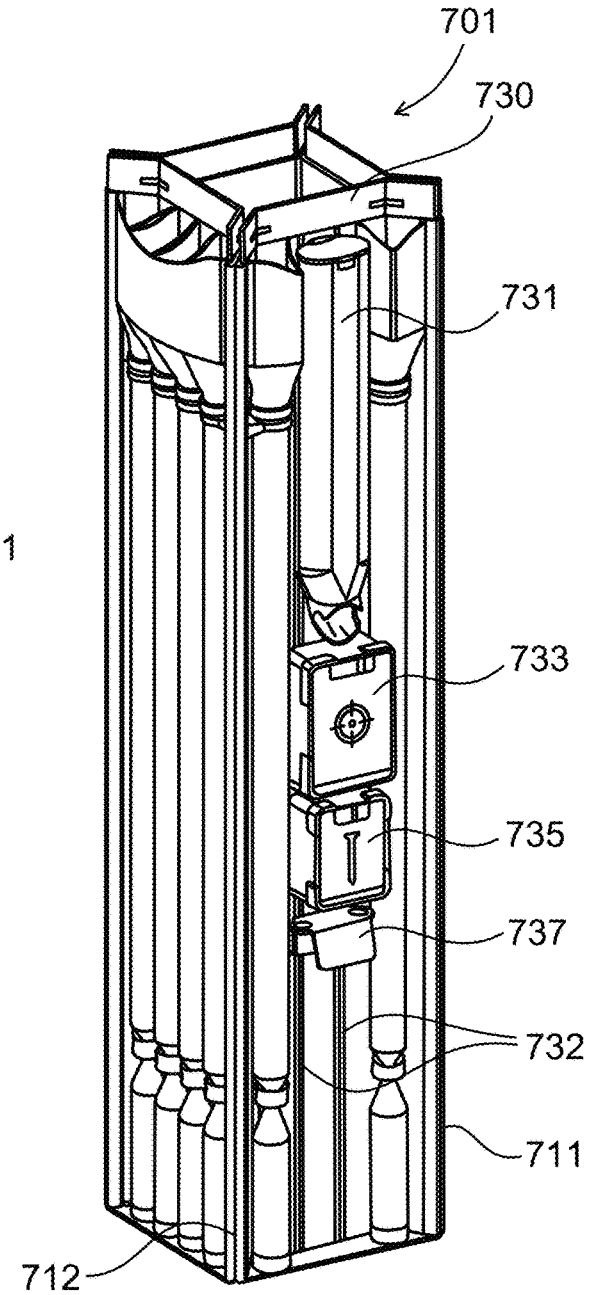
FIG. 9 is a perspective view of the golf bag of FIG. 9, showing the accessory rack.

Now referring to FIGS. 8 and 9, we see another embodiment of a golf bag 701 in playing mode. As with the embodiments already discussed, this bag comprises four panels, each with a middle section 703, a first wing 705 and a second wing 707. The angle between the wings and center sections are all preferably 135°. All four panels are connected through a hinge 711. In this embodiment, the hinge is a strip of pliable material, preferably leather, that is sewn into the appropriate edges of the wings. Other materials, such as polymers can be used for this hinge.

As seen in these Figures, the bag preferably includes a base when in playing mode, which is formed by the end caps 709 coming together when the panels are folded in to the playing mode. Preferably, these end caps are shaped so as to close off the interior of the bag when in the playing mode. In this way, the interior can be used to carry additional equipment, such as an umbrella, ball retriever and the like. Preferably, the travel mode cover also fits within this cavity. Owing to the depth of the cavity, some embodiments include straps or other means of pulling equipment up from the bottom.

The embodiment depicted in FIGS. 8 and 9 has a different design for the sleeves for insertion of the club shafts. In this embodiment, there is an opening 713 at the top of the sleeve formed by dividers 714 and an outer band 716. The dividers and outer band are preferably made from a material that is resilient, pliable, and elastic. Suitable materials are silicone rubber, nitrile rubber, butyl rubber, styrene-butadiene rubber, and thermoplastic elastomers, such as polyurethanes, polyesters and polyolefins. When the dividers and outer band have these properties, this upper part of the sleeves can be compressed as the bag is folded into the travel mode. As the upper part is compressed, the shafts of the clubs are gripped and somewhat stabilized in the travel mode. To facilitate this griping of the shafts, the dividers 714 preferably have two walls that separate from each other when the upper part is compressed in the travel mode.

In this embodiment depicted in FIGS. 8 and 9, the sleeves also include funnel sections 717 that transitions the sleeve to the fabric tubes 717. These funnel sections are preferably made from the same material as the dividers and outer bands. It is important that the inside surfaces of all the components of the sleeves does not abrade or otherwise harm the grips or shafts of the clubs.

The long section of the sleeves in this embodiment are formed from a fabric tube 717. These fabric tubes may be seamed lengthwise, or may be knitted, like a sock. The fabric should be wear resistant. Suitable fabrics include a fabric woven or knitted from cotton, polyester, rayon or nylon. Currently, nylon is preferred, so as to be moisture stabile. The top 720 of the fabric tubes are attached around the bottom of the funnel sections, preferably by a ring-type fastener 722. The bottom 719 of the fabric tubes are attached to a feature 724 on the end cap 709. This attachment may be made with a mechanical snap ring and/or with an adhesive.

Each of the fabric tubes is supplied with a ring 721 that surrounds and restricts the fabric tube. The hole through the middle of the ring is large enough so that the ring can be slid along the fabric tube, but small enough so that it keeps the end of the club shaft from passing through. In this way, as the wing is moved along the fabric tube, the depth to which a club shaft can be inserted is changed. Preferably, the ring is movably attached to the panel behind it. More preferably, the panels each include a slot for each of the sleeves and the back of the ring engages that slot and moves vertically within it.

Figure 23:
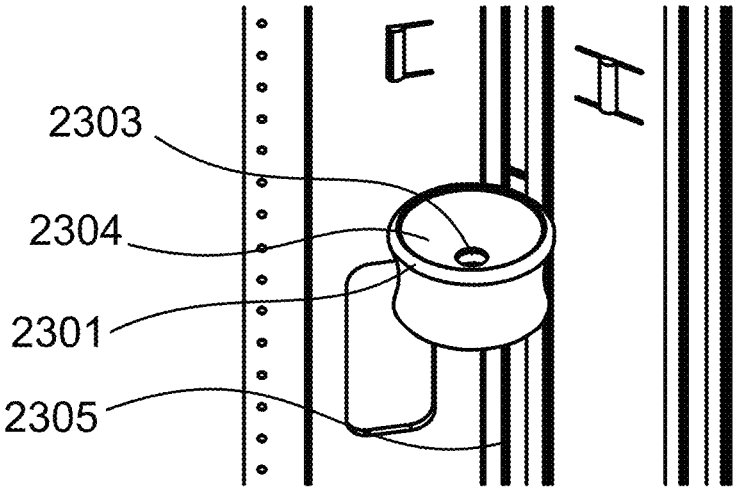
FIG. 23 is a perspective view of the height adjusting ring riding in a slot on a panel.
Figure 24:
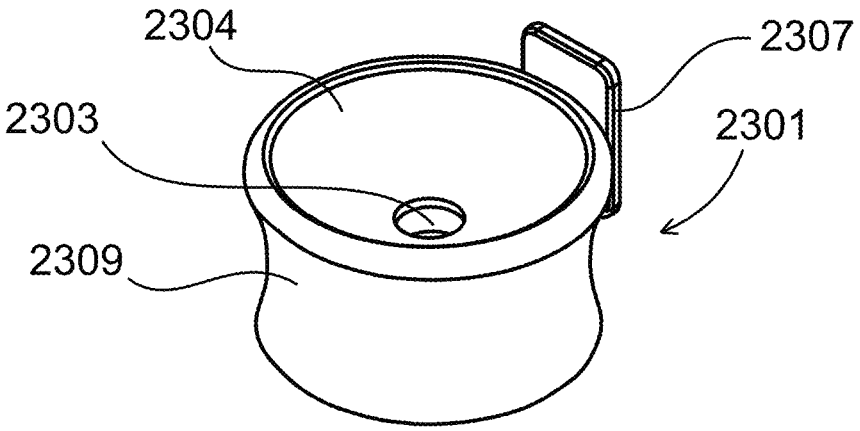
FIG. 24 is a perspective top, side view of the height adjusting ring.
Figure 25:
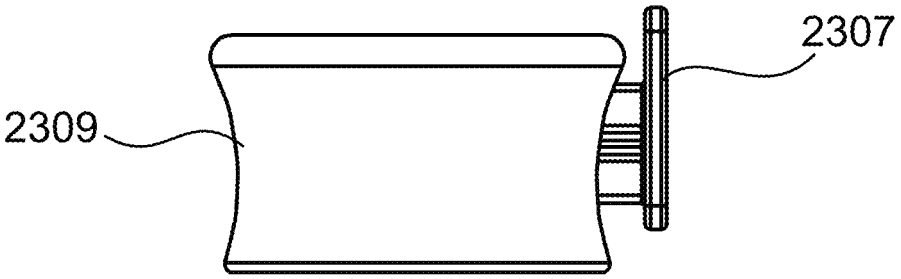
FIG. 25 is a perspective side view of the height adjusting ring.

FIGS. 23-25 illustrate this height adjustment ring. As shown, the height adjustment ring 2301, with the fabric sleeve removed for ease of viewing, rides in a vertical slot 2305. A back plate 2307 is captured within the slot 2305 to keep the ring 2301 in its track. The ring includes a hole 2303, through which the fabric sleeve passes and is constrained thereby. The ring comprises a smooth, bowl-like face 2304, which guides the fabric sleeve through the hole and also serves as a resting base for the end of the golf club shaft inserted therein. The ring also comprises a concave outer surface 2309, which facilitates a user gripping the ring to move it up and down.

FIG. 9 shows the panel 730 with the accessory rack. The rack includes two vertical slots 732. These slots are configured for attaching the accessories at different heights. The accessories shown include a ball holder 731. As shown, this ball holder preferably includes a lid on top and an exit for a single ball at the bottom. Preferably, this ball holder is mounted near the top of the accessory rack, so that the strap for a motorized golf car or pull behind golf cart can pass over it, and thus not interfere with other accessories on the rack.

The accessories also include a holder for a range finder 733. Preferably, this holder includes a lid or door that closes securely during transport. Also, it is preferred to include a padded surface on the inside of the holder, so as to best protect the range finder.

The accessories also include a holder or box for tees 735. This box has a door that snaps close, to provide easy access and a secure closure for transport.

The fourth accessory on the depicted rack is a golf glove holder 737. As depicted, the glove holder includes a fuzzy surface to which the hook side of the Velcro closure on most golf gloves can be removably attached. The holder is sized so that both a left and right handed glove can be attached. In alterative embodiments, the golf glove holder is a box or bag into which the gloves can be stowed when not in use.

Additional accessories can be attached or swapped out with the accessories shown in FIG. 9. These include such items as beverage holders, umbrella holders, towel holders, golf club headcover holders, ball retriever holders, scorecard holders, sunglasses holders, sunscreen holders and first aid kit holders.

While vertical slots are preferred for the accessory rack, alternative embodiments utilize an array of openings in the rack, into which clips on the accessories are inserted. For example, see the openings 1603 formed in the panel in FIG. 26.

FIGS. 10 and 11 depict two sides of the bag of FIGS. 8 and 9, in the travel mode with the travel mode cover 901 attached. As seen, the travel mode cover includes two wheels 905. A leather hinge 903 is used to open and close the travel mode cover. Block 907, which includes a pull strap 909, helps hold the panels together in the travel mode.

Figure 13:
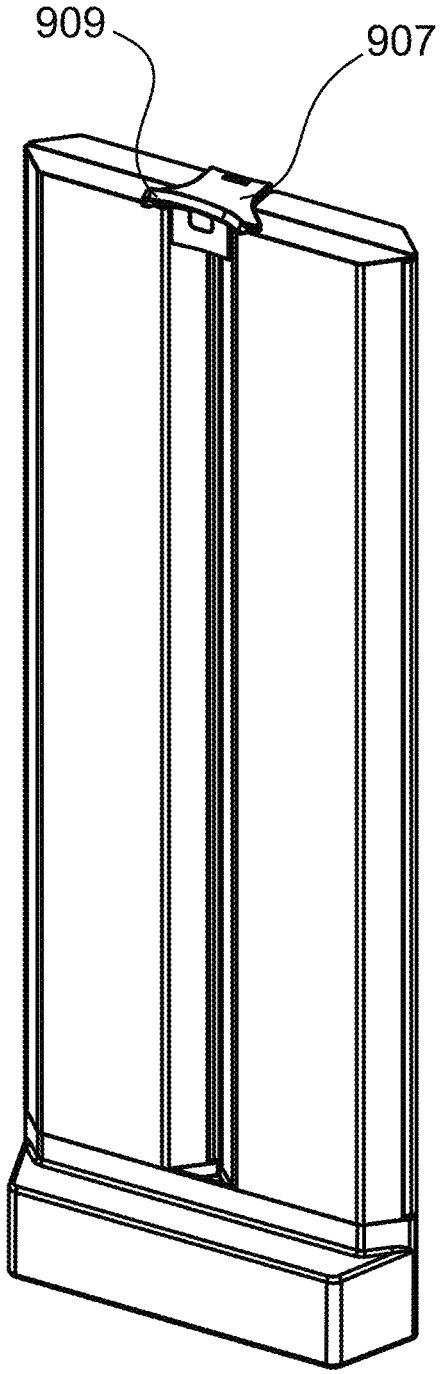
FIG. 13 is a perspective view of the golf bag of FIG. 12 from the opposite side.

FIGS. 12 and 13 depict two sides of the bag of FIGS. 8 and 9 in full-travel mode, that is with the cover 901 attached and the travel mode cover and club heads toward the bottom. The block 907 includes a pull strap 909. As the bag is leaned back, the wheels 909 engage the ground and the bag can be pulled or pushed along.

Figure 14:
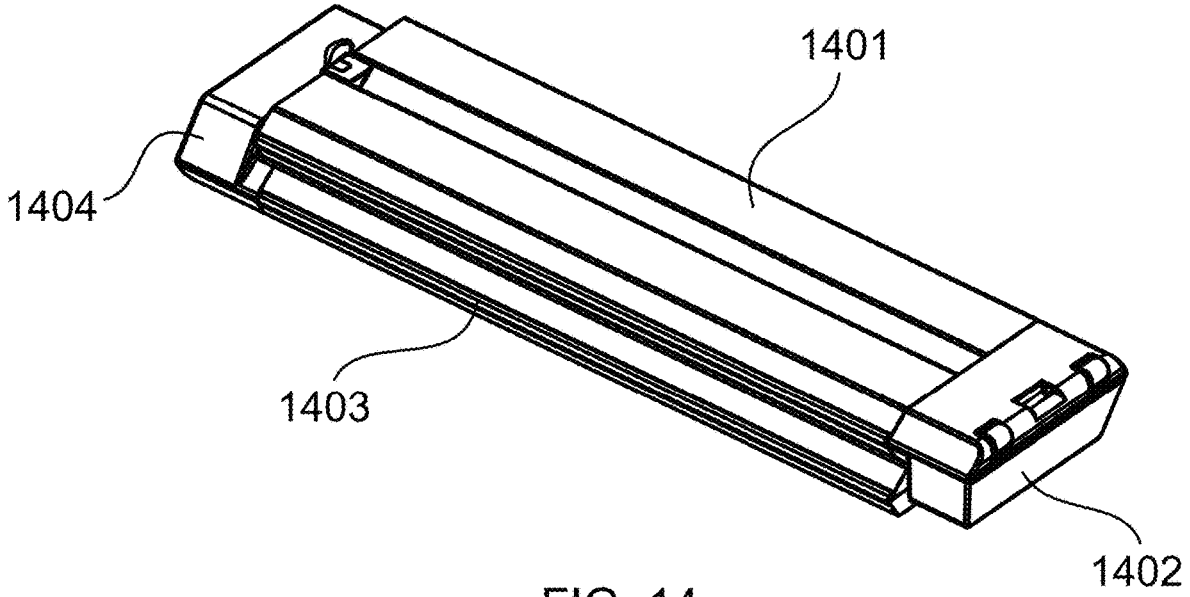
FIG. 14 is a perspective view of two stacked bags, alternated for dense stacking.

One advantage of this configuration is that the bag in travel mode is relatively flat and thin. This makes the bag easier to stow in a car or on an airplane. Also, it is possible to stack two or more such bags for storage or for moving multiple bags through an airport or resort. For example, two bags stacks, with one on top of the other should fit more easily in the trunk of a car. This stacking of two bags is depicted in FIG. 14, which shows bag 1401 stacked on top of bag 1403. In the depicted case, the orientation of the bags is alternated. In other words, the travel mode cover of bag 1401 with its foot 1402 is dropped over the end of the bag 1403 and the travel cover of bag 1403, with its foot 1404 pass over the end of bag 1401. Preferably, the bags are equipped with clips, latches or other means, such as magnets or Velcro®, to hold the bags together in this tandem mode.

Figure 15:
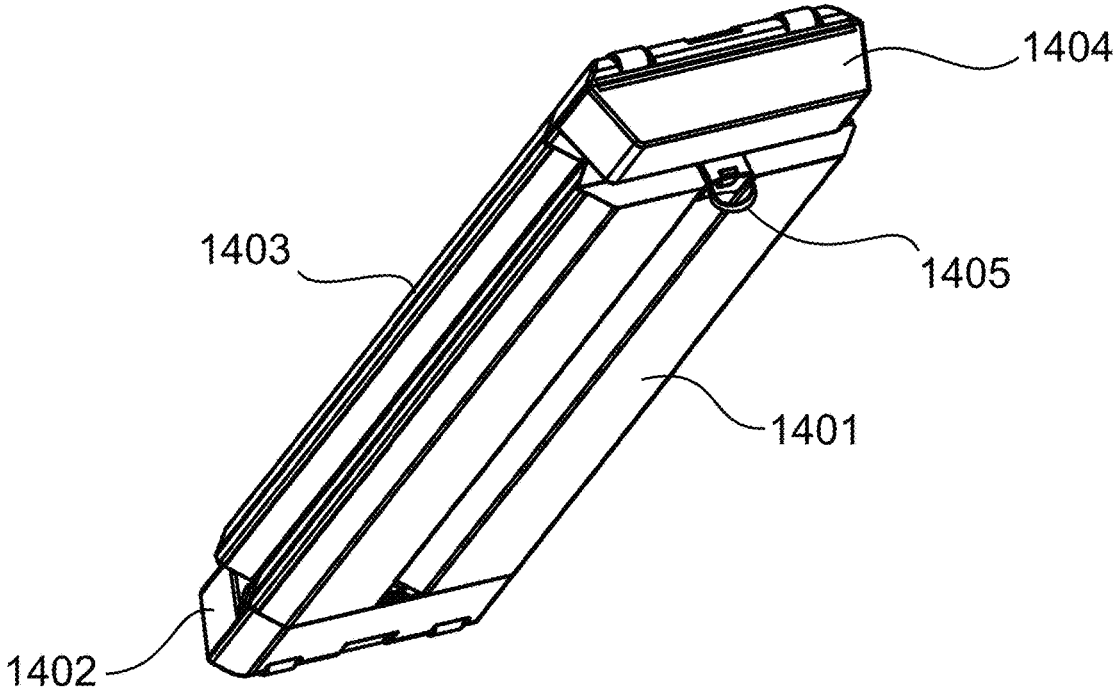
FIG. 15 is a perspective view of the two stacked bags of FIG. 14 ready to be pulled.

FIG. 15 shows the two stacked bags 1401 and 1403 ready to be pulled through an airport by the pull strap 1405 on bag 1401.

Figure 16:
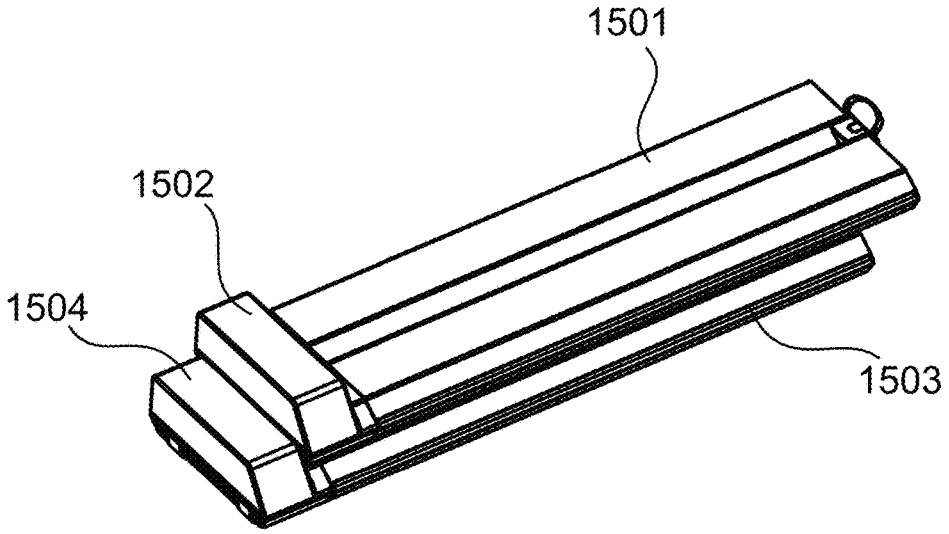
FIG. 16 is a perspective view of two stacked bags oriented the same direction.
Figure 17:
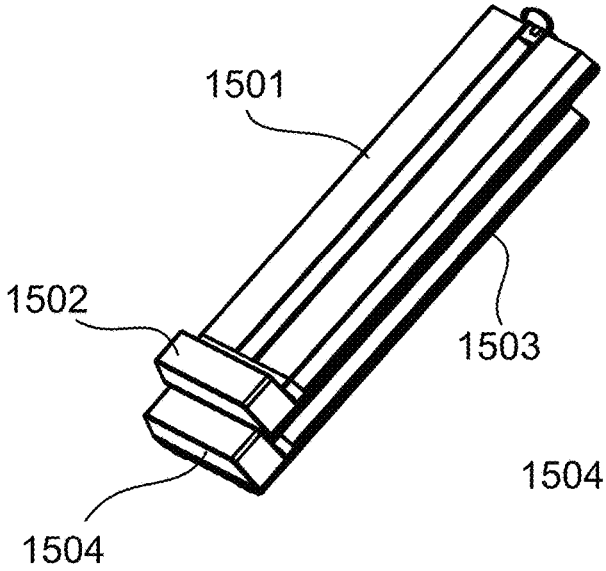
FIG. 17 is a perspective view of the two stacked bags of FIG. 16 ready to be pulled.
Figure 18:
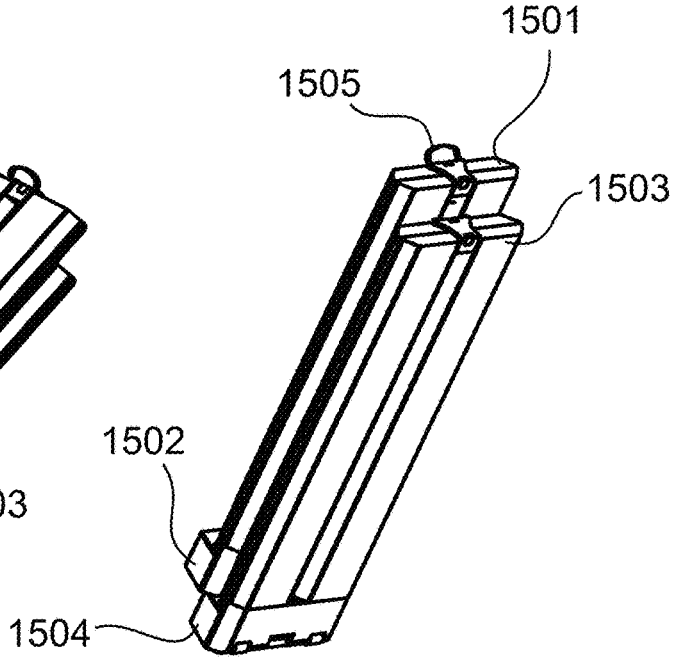
FIG. 18 is a perspective of the two stacked bags of FIG. 17 from the other side.

FIGS. 16-18 illustrate another stacking mode, namely with the travel mode covers and feet at the same end. In particular, bag 1501 is placed on top of bag 1503, with the travel covers 1502 and 1504, respectively, at the same end. When tilted up, the foot of the travel cover 1504 supports the foot of the travel cover 1502. The two bags can be pulled with the pull strap 1505. In this stacking mode, the two bags may be affixed to each other with clips, latches, Velcro®, magnets, straps or elastic cords. Alternatively, the two bags may be secured merely by gravity.

This flat shape and the foot also facilitate placing other items of luggage on top of the bag. In other words, the bag can be used as a luggage dolly in airports and such. The foot of the travel mode cover is particularly useful to retain bags on top of the bag during pulling through an airport, or the like. In alternatively embodiments, the bag is provided with straps or elastic cords for securing luggage on top of the bag when being pulled.

Figure 19:
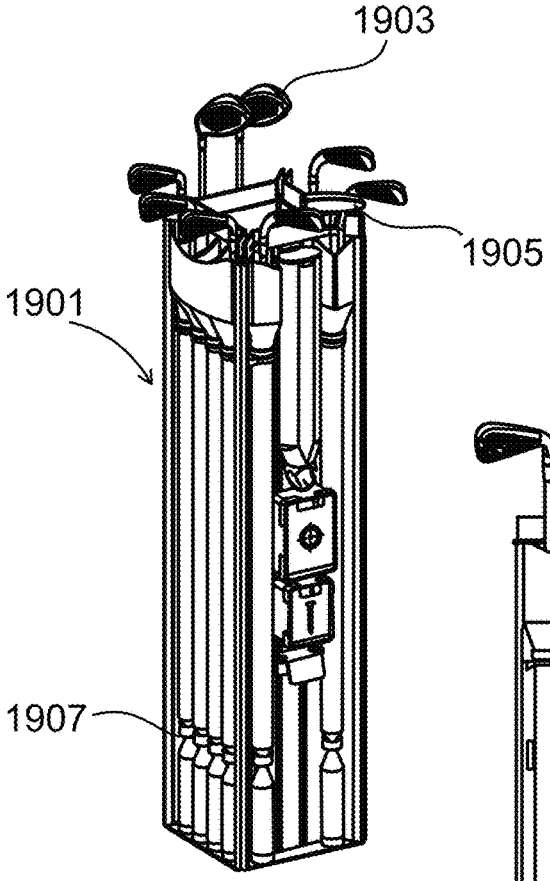
FIG. 19 is a perspective view of a golf bag of another embodiment, showing height adjustability of the sleeves and an accessory rack.
Figure 20:
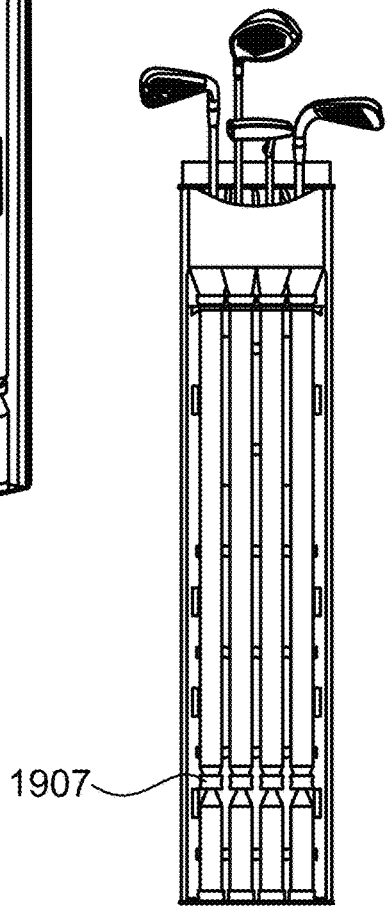
FIG. 20 is a perspective view of the bag of FIG. 19 from another side with the club heights in playing mode.

FIGS. 19-22 depict a similar embodiment. FIG. 19 shows the bag in play mode with the club heads at typical heights, i.e. with the driver 1903 sticking out the further from the bag and the putter 1905 sticking out the least. This is typical, since most bags are just tall enough for the putter to protrude, while the driver, being the longest club, sticks out the most. Thus, some golfers may prefer to set the club height stoppers 1907 at the same height when in play mode. This is shown in FIG. 20. Alternatively, some golfers may choose to fine tune the height of the club heads, to, for example, have the most often used clubs, such as a pitching wedge, sticking out further.

Figure 21:
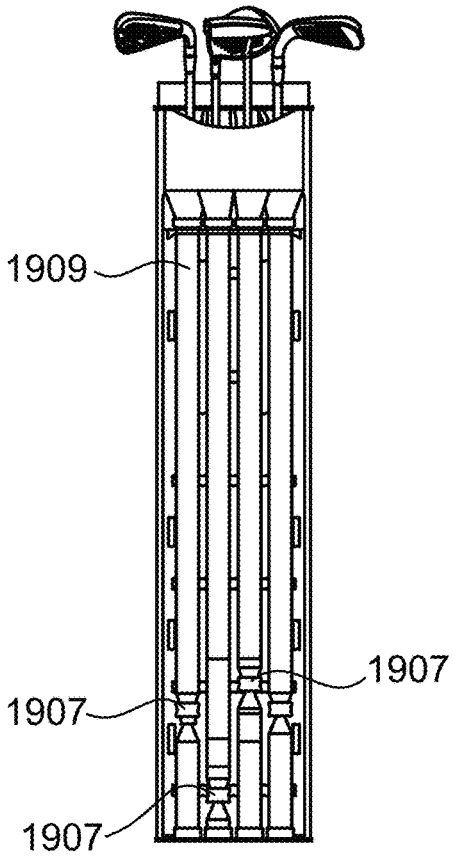
FIG. 21 is a perspective view of the bag of FIG. 20 with the club heights in travel mode.

FIG. 21 depicts the height adjustment stoppers 1907 adjusted so as to bring all of the club heads down to the same height, i.e. just above the top of the sleeves 1909. In this way, the clubs are readied for travel mode and being covered with the travel mode cover.

Figure 22:
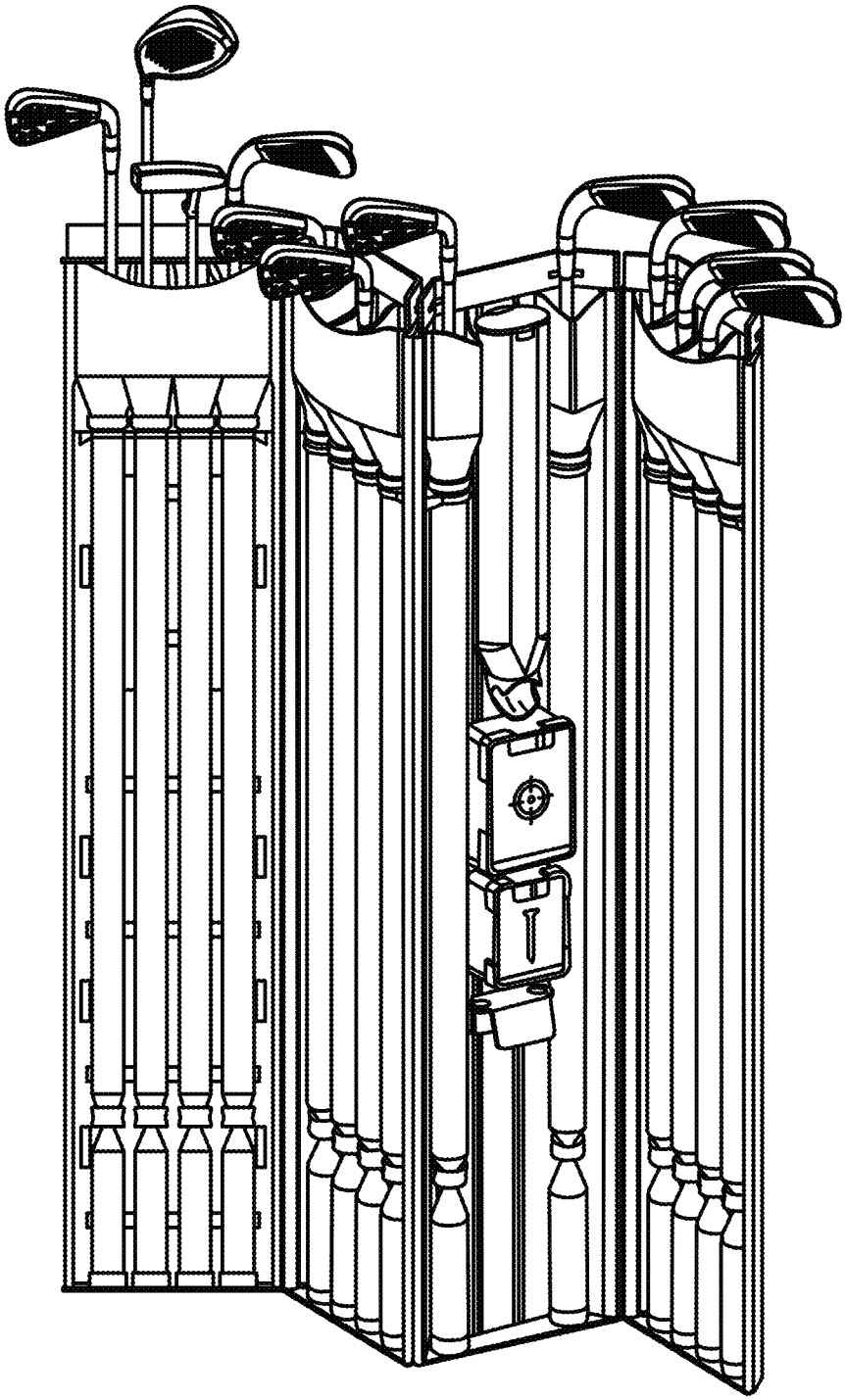
FIG. 22 is a perspective view of the bag of FIG. 19 being folded into travel mode.

FIG. 22 depicts the same bag as in FIGS. 19-21, which is being folded into the travel mode. As can be seen, all of the club heights are set the same by the club height stoppers.

Figure 26:
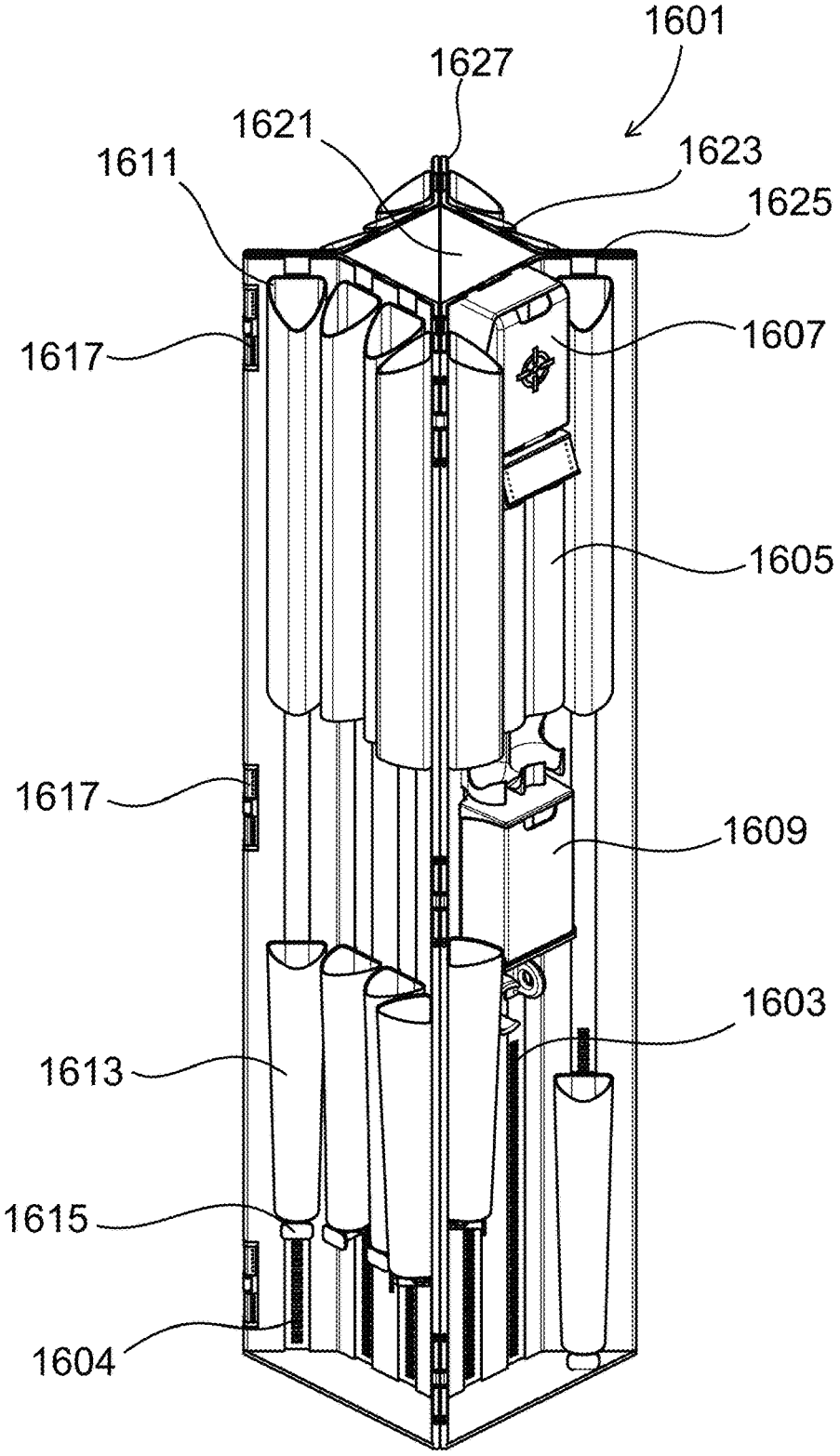
FIG. 26 is a perspective view of another embodiment of the bag.

FIG. 26 shows an alternative embodiment of a multi-function golf bag 1601 in its playing mode. As with the other bags, it consists of four panels 1621, each with central sections 1623 and wings 1625 and 1627. The four panels are connected through hinges 1617.

Figure 27:
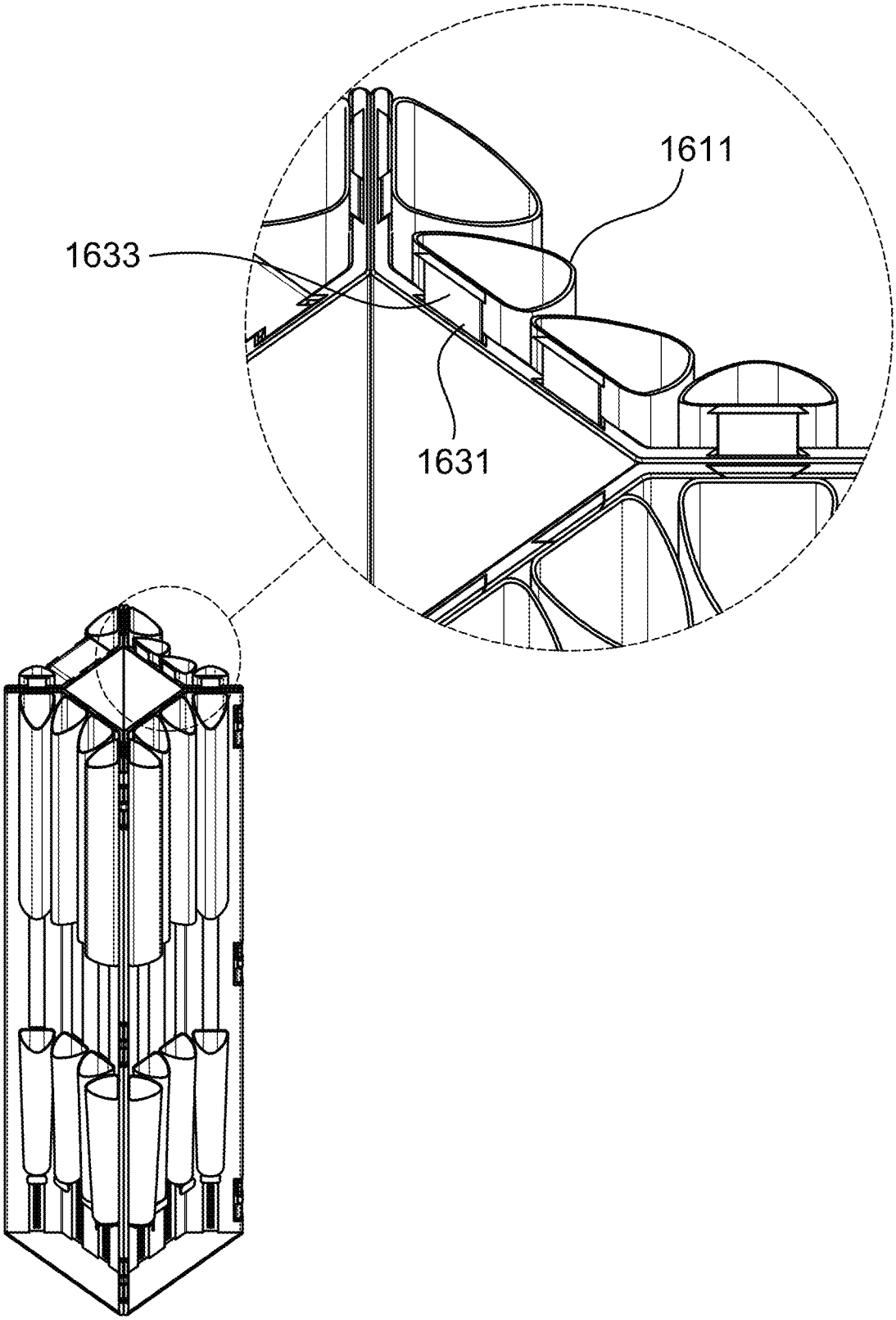
FIG. 27 a perspective view, showing attachment of the sleeves to the panels.

Sleeves, including an upper portion 1611 and a lower portion 1613 are attached to the panels. As best seen in FIG. 27, the upper portion of the sleeve 1611 is attached to the panel by means of a keyhole slot 1631 in the panel and a complementary protrusion 1633 on the back of the portion 1611.

Figure 28:
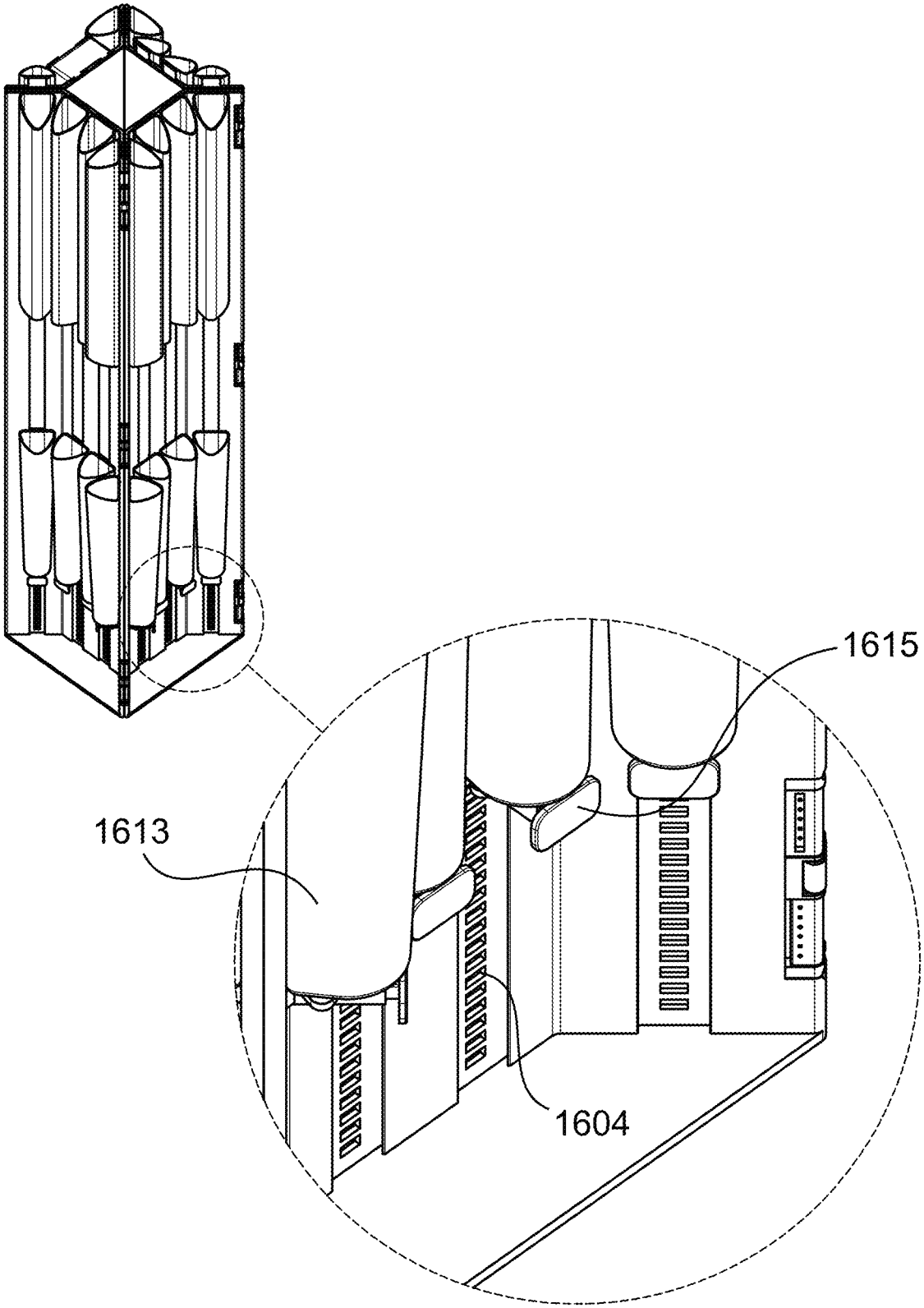
FIG. 28 is a perspective view of the golf bag of FIG. 26, showing an alternative embodiment for height adjustment of the bottom of the sleeves.

Turning to FIG. 28, the bottom portions 1613 of the sleeves are adjusted for height by means of the array of openings 1604 and the tabs 1615 that are releasably inserted therein.

Figure 29:
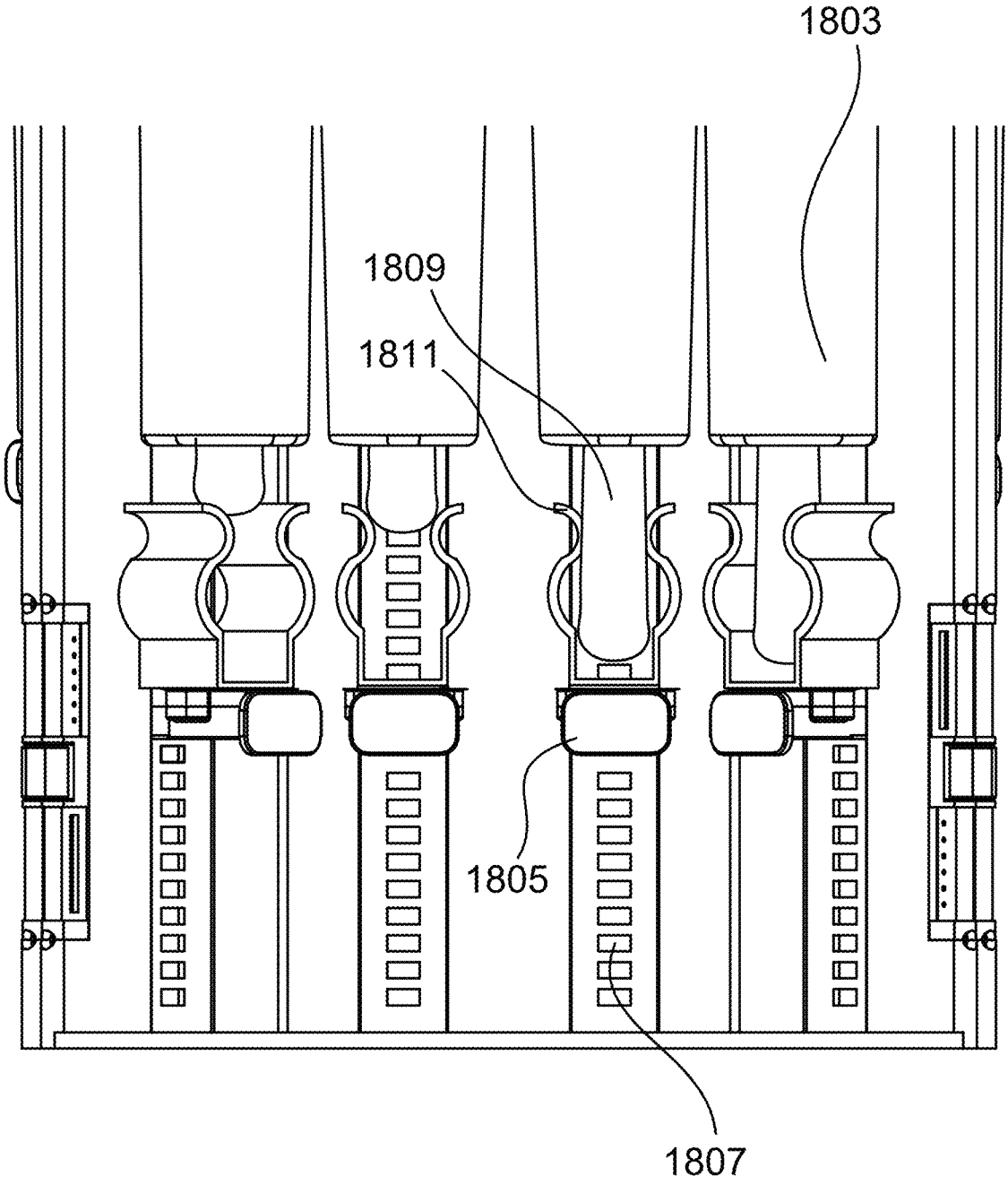
FIG. 29 is a perspective view of an alternative embodiment, with grippers for the top of the club shafts.

FIG. 29 shows the bottom of a panel in an alternative embodiment. This embodiment includes height adjustable sleeves 1803 that are held in place by the tabs 1805 being inserted into one of the openings in the array of openings 1807. This embodiment also includes grippers 1811, into which the end of the golf shaft 1809 is inserted. The grippers are made of a spring-like material, with just enough bias to facilitate easy insertion of the golf shaft, and provide some holding force for the shaft, especially during transit. In use, the golfer typically does not push the club down far enough for the shaft to be gripped. However, when getting ready to put the bag in the travel mode, the clubs are pushed down just a little hard, so that the shaft is gripped, and the clubs are further stabilized for transit.

Figure 30:
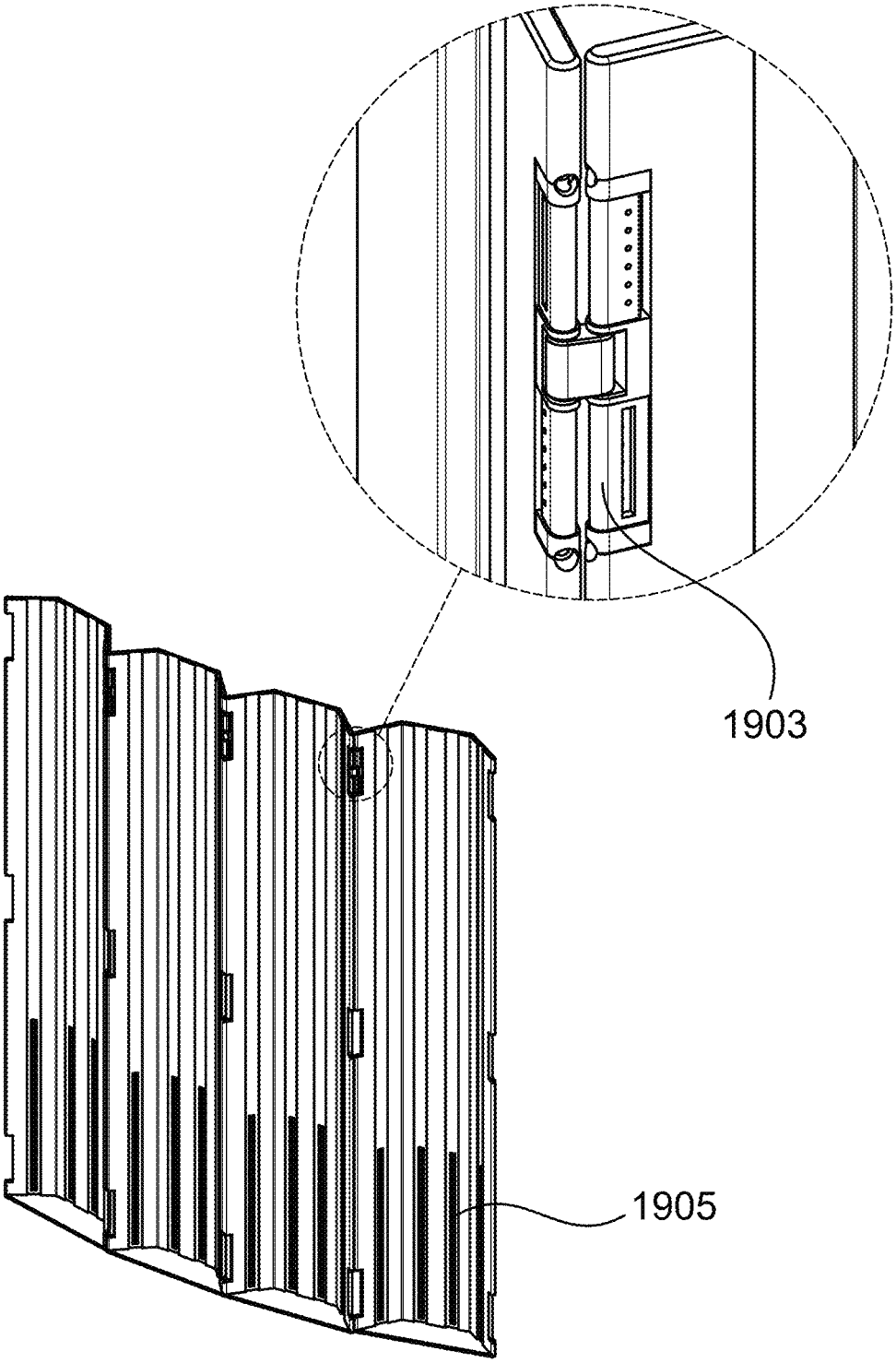
FIG. 30 is a perspective view of an alternative embodiment of the golf bag with hinges between the panels.

FIG. 30 depicts and alternative embodiment with a different type of hinge 1903 between the four panels. As seen, the embodiment uses three flush hinges to connect each pair of panels. This FIG. 30 also shows the vertical array of openings 1905 formed in the panels for vertical adjustment of the stoppers used to adjust the club height in the bag.

Figure 31:
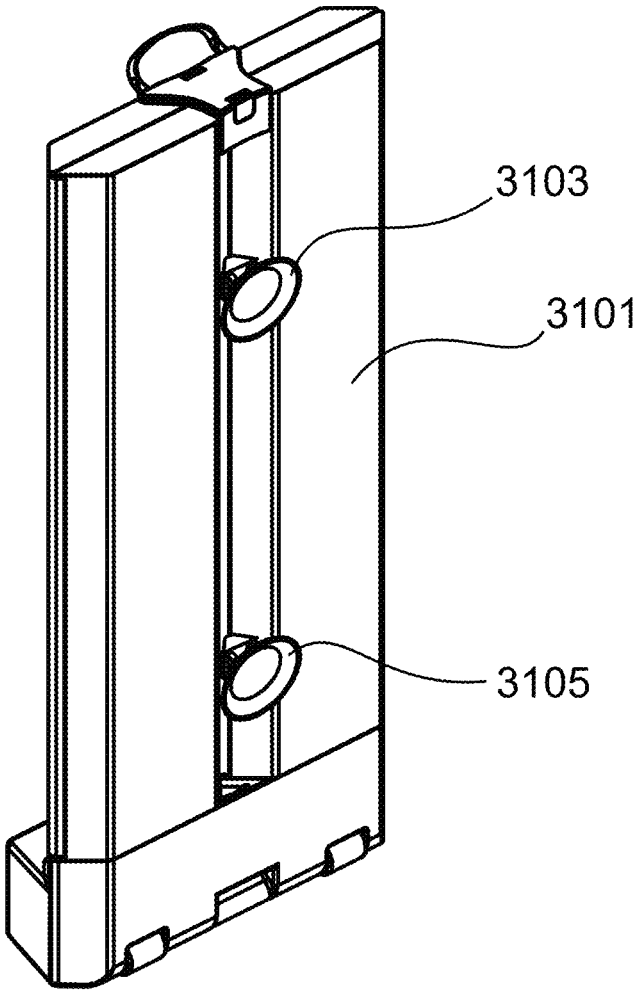
FIG. 31 is a perspective view of a golf bag in travel mode with suction grippers attached thereto.
Figure 32:
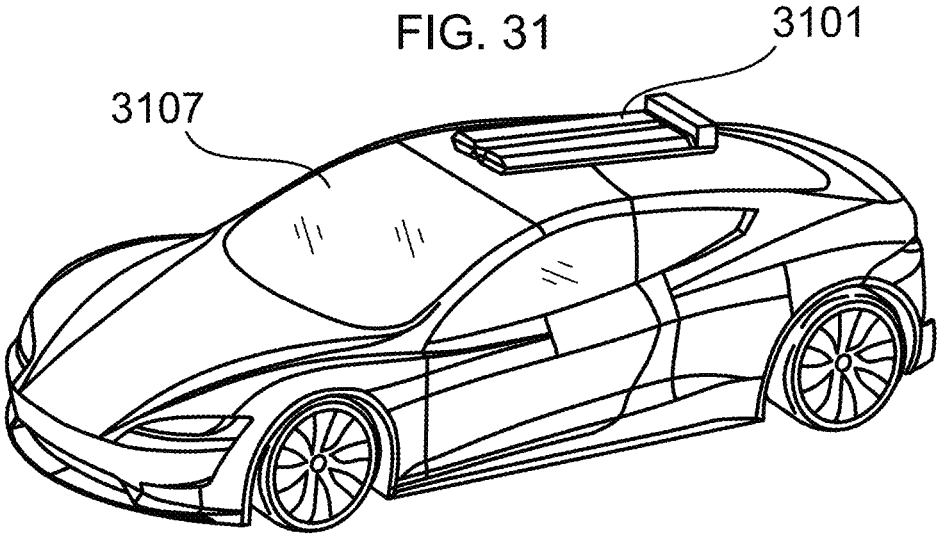
FIG. 32 is a perspective view of the golf bag of FIG. 31 attached on the top of a vehicle by suction grippers.

FIG. 31 depicts an embodiment, wherein the bag 3101 includes two suction grippers 3103 and 3105. As shown in FIG. 32, these suction grippers are used to attach the bag 3101 to the top surface of the vehicle 3107. While depicted on the top of the vehicle, the suction grippers may be used to attach the bag to a sloped surface, such as a hatchback or other surface of a vehicle.

Figure 33:
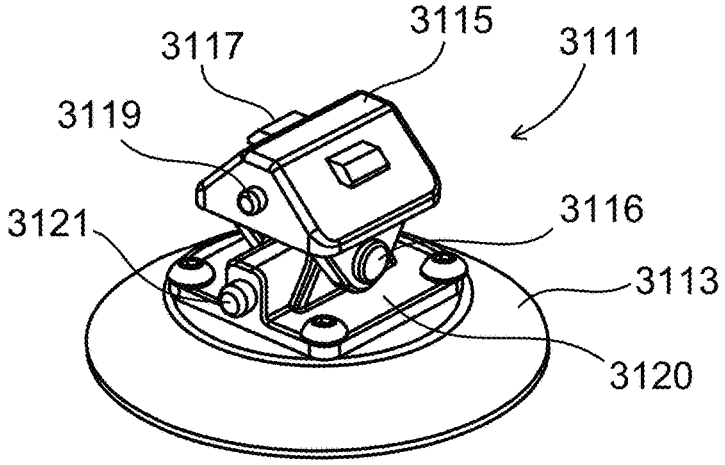
FIG. 33 is a perspective view of the preferred suction gripper.

FIG. 33 depicts the preferred suction gripper 3111. The gripper includes a pliable, frustoconical base 3113, made from rubber or some other suitable material that will form a good airtight seal with the surface of the vehicle. Sitting on top of the base is a pump mechanism 3120, actuated by the button 3121. This pump mechanism operates by the user repeatedly pushing the button 3121 to pump air out of the cavity below the base 3113. More pumps of the button 3121 produces great suction. To release the suction, the button 3121 is pushed further in and longer by the user, which releases the suction of the base, thus releasing the gripper from the vehicle surface.

Pivotally connected to the mechanism 3120, through pivot pin 3116, is the wedge block section 3115. The wedge block section 3115 is pivotally connected so as to provide angular adjustment between the bag and the vehicle surface. This section 3115 includes two spring loaded tabs 3117, which are biased outwardly by a spring or other means. The button 3119 is used to retracts these tabs when pressed.

Figure 34:
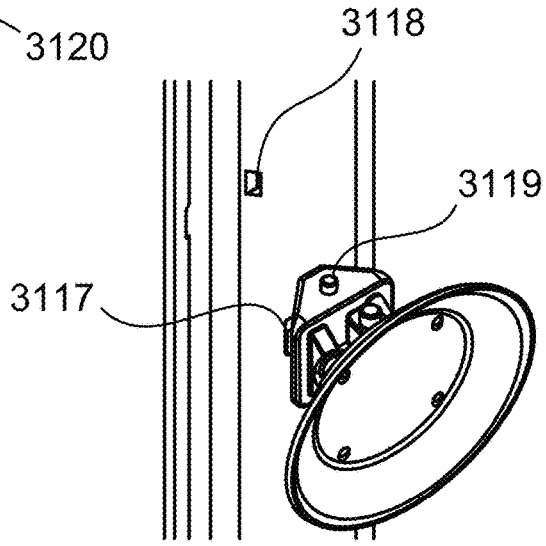
FIG. 34 is a perspective view showing attachment of the suction gripper to the golf bag.

As can be seen in FIG. 34, the wedge block section is shaped to fit the angled channel formed in the center of the bag when in the travel mode. Detents 3118 formed in this channel are shaped to capture the tabs 3117 and thus securely lock the gripper to the bag. To release the bag from the gripper, the button 3119 is pressed to retract the tabs.

Figure 35:
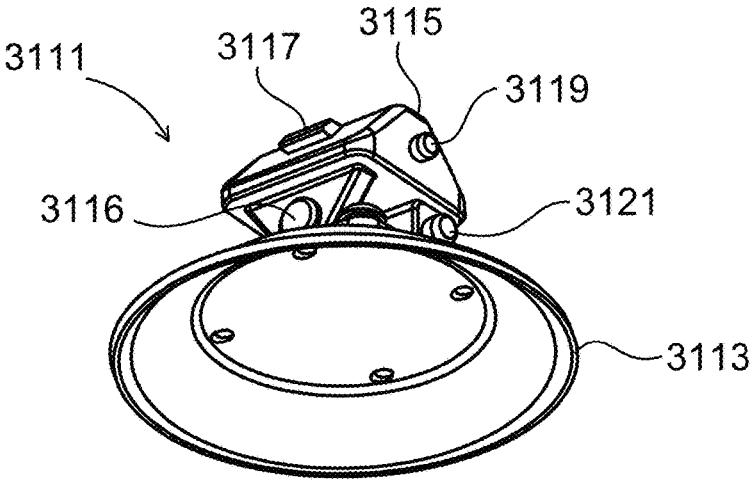
FIG. 35 is a perspective view of the bottom of the preferred suction gripper.

FIG. 35 shows the underside of the gripper 3111. As shown, the frustoconical base 3113 forms a cavity thereunder. When placed on the vehicle surface, this forms a sealed cavity. The pump mechanism actuated by button 3121 draws air from this sealed cavity and thus produces suction between the gripper and the vehicle surface.

Figure 36:
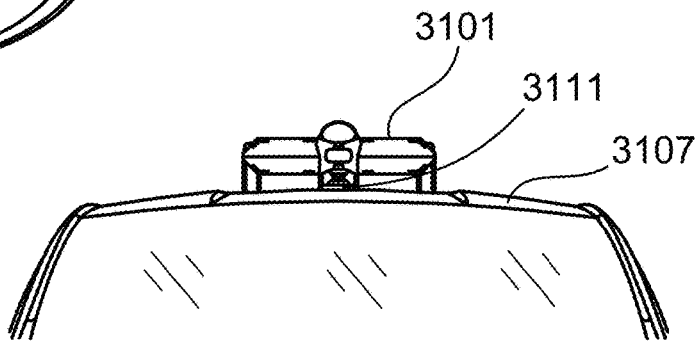
FIG. 36 is a perspective view showing how the suction gripper is accessible between the golf bag and the top of the vehicle.

FIG. 36 shows the bag 3101 mounted on the vehicle 3107 by the gripper 3111. As shown, the buttons to actuate the pump and to release the gripper from the bag are accessible to the user.

The invention has been described with reference to various specific and preferred embodiments and techniques. Nevertheless, it is understood that many variations and modifications may be made while remaining within the spirit and scope of the invention.

What is claimed is:

1. A bag for carrying a set of golf clubs while playing golf and while traveling, the bag comprising:

first, second, third and fourth panels, each of which panels comprises:

a middle section with first and second opposing faces, and with first and second opposite sides edges;

a first wing section extending at a first angle from the first side edge of each panel;

a second wing section extending at a second angle from the second side edge of each panel;

a first hinge connecting the second wing section of the first panel to the first wing section of the second panel;

a second hinge connecting the second wing section of the second panel to the first wing section of the third panel;

a third hinge connecting the second wing section of the third panel to the first wing section of the fourth panel;

at least one closure releasably connecting the first wing section of the first panel to the second wing section of the fourth panel;

first, second, and third club holding components, each connected to one of the first, second, third and fourth panels, each of the club holding components comprising at least three sleeves for receiving shafts of golf clubs;

wherein all of the hinges and the closure allow the bag to be folded into a playing mode with the connected wing sections touching each other and the first faces of the middle sections and the club holding components facing outward; and wherein all of the hinges and the closure also allow the bag to be folded into a travel mode with two of the first, second, third and fourth panels being adjacent with the middle sections facing and club holding components facing inward and with an other two of the first, second, third and fourth panels are adjacent with the middle sections and club holding components facing inward.

2. The bag of claim 1, wherein the first and second angles are 135 degrees.

3. The bag of claim 1 further comprising a travel mode cover for covering heads of the golf clubs.

4. The bag of claim 3, wherein the travel mode cover comprises wheels, and wherein the bag is configured to be oriented with the travel mode cover at the bag's bottom and pulling or pushing the bag by a user is facilitated by the wheels.

5. The bag of claim 4, wherein the wheels only touch ground when the bag is leaned at an angle for pulling and pushing.

6. The bag of claim 4, wherein the bag further comprises a handle near the bag's top to facilitate pulling or pushing the bag.

7. The bag of claim 4, wherein the travel mode cover is configured with a shape and size to allow the bag to stand vertically on its own.

8. The bag of claim 3, wherein the travel mode cover is configured to facilitate holding the bag in the travel mode.

9. The bag of claim 3, wherein the travel mode cover is shaped so that two or more similar bags in travel mode stacked for transport.

10. The bag of claim 1, wherein the first, second, and third club holding components each comprise four sleeves for receiving shafts of golf clubs.

11. The bag of claim 10, wherein each of the sleeves includes a vertically adjustable stopper to engage an end of the received golf club shaft at different heights.

12. The bag of claim 10, wherein each sleeve is configured to cover shafts of the golf clubs inserted therein.

13. The bag of claim 1, wherein the first, second, and third hinge each comprise a strip of pliable material with a first and second edge, which first and second edges are attached to the respective wing sections.

14. The bag of claim 1, wherein the closure comprises magnets attached to the first wing section of the first panel and attached to the second wing section of the fourth panel.

15. The bag of claim 1, further comprising an accessory rack on the first face of the middle section of the first, second, third, or fourth panels that does not have one of the first, second, or third club holding components mounted to it, the accessory rack configured for mounting accessories selected from the group consisting of golf ball holders, rangefinder holders, beverage holders, tee holders, glove holders, umbrellas, towel holders, golf club headcover holders, ball retriever holders, scorecard holders, sunglasses holders, sunscreen holders, first aid kit holders, and combinations thereof.

16. The bag of claim 15, wherein the accessory rack comprises at least two vertical slots by which the accessories can be mounted to the accessory rack at different heights.

17. The bag of claim 16, wherein the accessories are each provided with a clip for engaging one or more of the at least two vertical slots.

18. The bag of claim 15, wherein the accessory rack comprises an array of openings of predetermined sizes and locations to facilitate mounting the accessories at different positions on the accessory rack.

19. The bag of claim 18, wherein the accessories are each provided with a clip for engaging at least one of the openings.

20. The bag of claim 18, wherein the panel that comprises the accessory rack also comprises two sleeves.

* * * * *